US006691624B2

(12) United States Patent
Albrich

(10) Patent No.: US 6,691,624 B2
(45) Date of Patent: Feb. 17, 2004

(54) CHAIR FOR CABLEWAY SYSTEMS

(75) Inventor: Reinhard Albrich, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 10/277,123

(22) Filed: Oct. 21, 2002

(65) Prior Publication Data

US 2003/0136298 A1 Jul. 24, 2003

(30) Foreign Application Priority Data

Jan. 24, 2002 (AT) ..... 113/2002

(51) Int. Cl.[7] ..... B61B 11/00
(52) U.S. Cl. ..... 105/149.2
(58) Field of Search ..... 105/148, 149.1, 105/149.2, 141, 147; 104/112, 115, 89

(56) References Cited

U.S. PATENT DOCUMENTS 3,747,974 A * 7/1973 Tauzin ..... 297/184.12
4,784,065 A * 11/1988 Brochand ..... 104/173.2
5,586,503 A * 12/1996 Rehorn ..... 104/241
6,520,573 B2 * 2/2003 Osterle ..... 297/184.11

* cited by examiner

*Primary Examiner*—S. Joseph Morano
*Assistant Examiner*—Robert J. McCarry, Jr.
(74) *Attorney, Agent, or Firm*—Laurence A. Greenberg; Werner H. Stemer; Gregory L. Mayback

(57) ABSTRACT

A chair for a cableway system is provided with a closure bar, which can be pivoted into a closed position about a axis running transversely to the direction of travel of the chair. The chair is preferably provided with a number of footrests which correspond to the seats. In a front region of each of the at least one seat there is provided a cam device or protrusion or the like which is coupled in terms of movement to the closure bar. When the closure bar is pivoted into its closed position, the cam device is adjusted to project upwardly centrally at the seat, that is, between the thighs of a person sitting on the respective seat of the chair.

10 Claims, 3 Drawing Sheets

CHAIR FOR CABLEWAY SYSTEMS

BACKGROUND OF THE INVENTION

Field of the Invention

The present invention relates to a chair for a cableway system. The chair is provided with a closure bar, which can be pivoted into a closed position about an axis running transversely in the direction of travel of the chair, and which is preferably provided with a number of footrests that are assigned to the seats.

Prior art chairs for cableway systems have a load-bearing frame on which a plurality of seats arranged one beside the other are fastened and which is provided with a more or less vertically upwardly projecting load-bearing bar, at the top end of which there is arranged a clamping device via which it can be coupled to the supporting and haulage cable of a cableway system. It is additionally possible to provide at the top end of the load-bearing bar a running-gear mechanism by way of which the chair, after it has been uncoupled from the supporting and haulage cable in the stations, can be moved along guide rails, at a speed which is lower than the speed of the haulage cable, through the boarding and disembarking regions.

Furthermore, for the purpose of securing the users, the chair is designed with a closure bar which can be pivoted, about a pin directed more or less transversely to the direction of travel of the chair, from an open position, in which it is pivoted up in relation to the chair, into a closed position, the users of the chair being secured, in the closed position, against sliding off the chair. The closure bar is preferably formed with footrests. In addition, the chair may be designed with a covering hood which serves for protecting the users against harsh environments in wind and weather.

Prior art chairs of this type, however, do not meet all the necessary requirements insofar as they are configured and designed for adult users. In the case of adult users, when the closure bar is in the closed position, the vertical distance of the closure bar from the seat surface is small enough for the users to be secured against sliding off. When the chair is used by children, however, this distance is large enough for the children not to be secured to a sufficient extent against sliding off the chair.

SUMMARY OF THE INVENTION

It is accordingly an object of the invention to provide a chair for a cableway system, which overcomes the above-mentioned disadvantages of the heretofore-known devices and methods of this general type and wherein, in the closed position of the closure bar, the chair users, irrespective of their height, that is to say in particular also children, are secured against sliding off the chair.

With the foregoing and other objects in view there is provided, in accordance with the invention, a chair assembly for a cableway system, comprising:

a chair formed with at least one seat;

a closure bar pivotally supported on the chair substantially transversely to a travel direction of the chair between a closed position and an open position;

a cam device disposed in a front region of the at least one seat, the cam device being coupled to the closure bar such that, when the closure bar is pivoted into the closed position, the cam device projects upward from a region substantially centrally and forward on the seat, i.e., the cam device is moved into a position substantially between the thighs of a person seated on the chair.

In other words, the objects of the invention are achieved in that, in the front region of each of the seats—the chair has at least one seat—there is provided a cam, a tappet, a protrusion or the like (generically referred to as a cam device) which is coupled in terms of movement to the closure bar. When the closure bar is pivoted into its closed position, it is possible for the cam device to be adjusted between the thighs of the at least one user of the chair.

This protrusion or the like in particular can be pivoted about an axis that is oriented at least more or less parallel to the pivot axis of the closure bar.

It is preferable for the closure bar to be assigned at least one control cylinder, which can be actuated by the closure bar pivoting, and for the at least one protrusion or the like to be assigned an actuating cylinder, the control cylinder and the actuating cylinder being connected to one another via a pressure-medium line. It is possible here for the at least one control cylinder and the at least one actuating cylinder to be respectively located on the rear side and on the underside of the chair.

According to a preferred embodiment, the control cylinder is connected to a plurality of actuating cylinders via pressure-medium lines. It is possible here for the cam devices or the like of each seat to be assigned a dedicated actuating cylinder. Alternatively, a plurality of protrusions or the like are connected mechanically to one another for pivoting purposes, and each of these groups of protrusions or the like is each assigned a single actuating cylinder.

Other features which are considered as characteristic for the invention are set forth in the appended claims.

Although the invention is illustrated and described herein as embodied in a chair for cableway systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
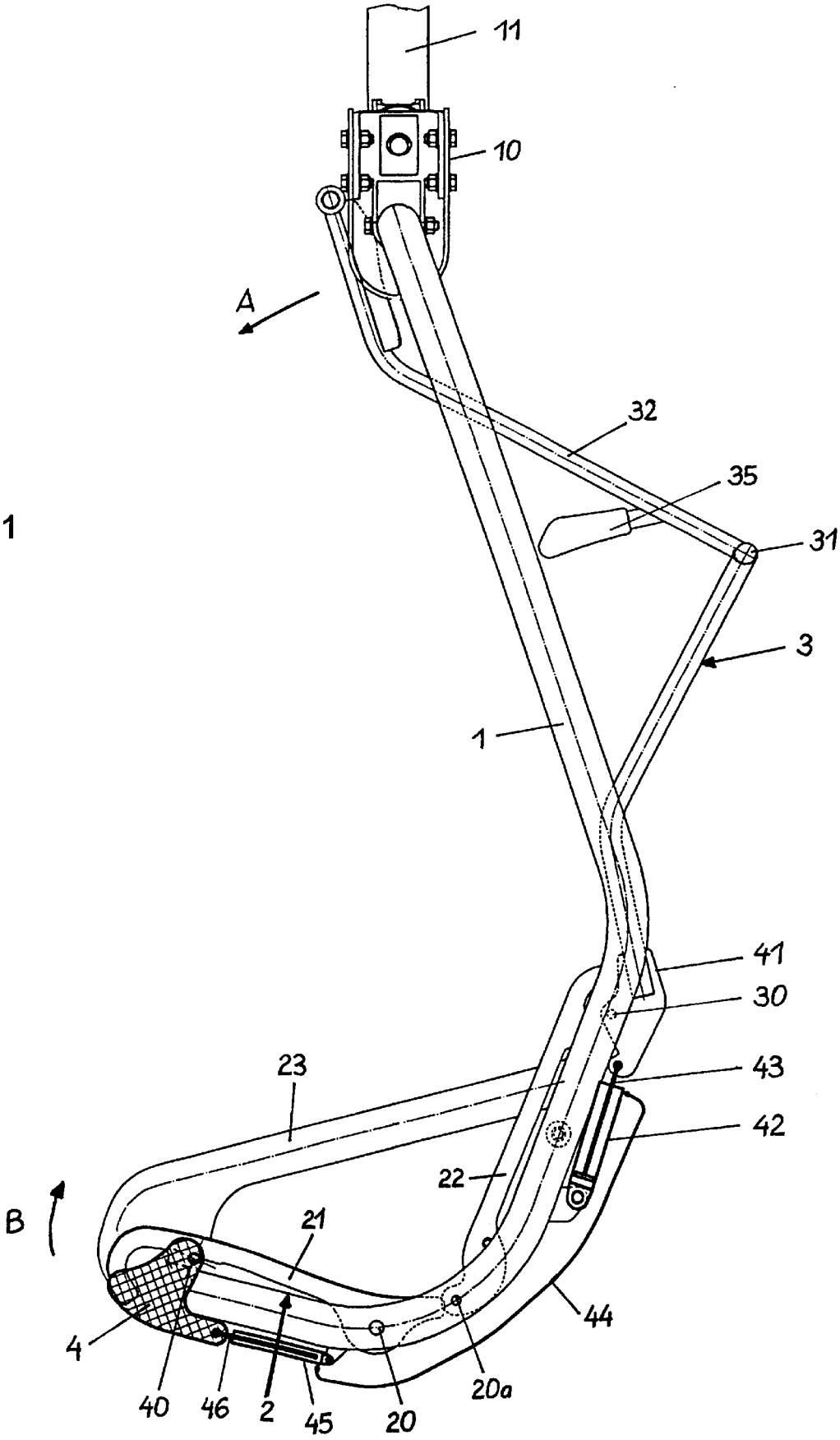
FIG. 1 is a side view of a chair according to the invention, with the closure bar in the open position.

Referring now to the figures of the drawing in detail there is shown a chair of a chair lift. The exemplary embodiment illustrated here is a so-called quad-chair, but the invention applies to a wide variety of such types of chairs. The chair according to the invention has a load-bearing frame 1 which extends transversely to the direction of travel of the chair and which is mounted in an articulation 10. This articulation 10 is located at the bottom end of a more or less vertically oriented load-bearing bar 11, at the top end of which a clamping device and, if appropriate, a running-gear mechanism are provided. The clamping device serves for coupling the chair to a supporting and haulage cable, and the running-gear mechanism, once the chair has been uncoupled from the supporting and haulage cable, serves for displacing the chair along rails, provided in the stations, through the boarding and disembarking regions.

Fastened one beside the other on the load-bearing frame 1 are a plurality of seats 2 which each comprise a seat surface 21 and a backrest 22, these being mounted on a load-bearing frame 1 such that they can be pivoted about pins 20 and 20*a*. The chair is designed with side panels 23 on its two end surfaces.

Figure 2:
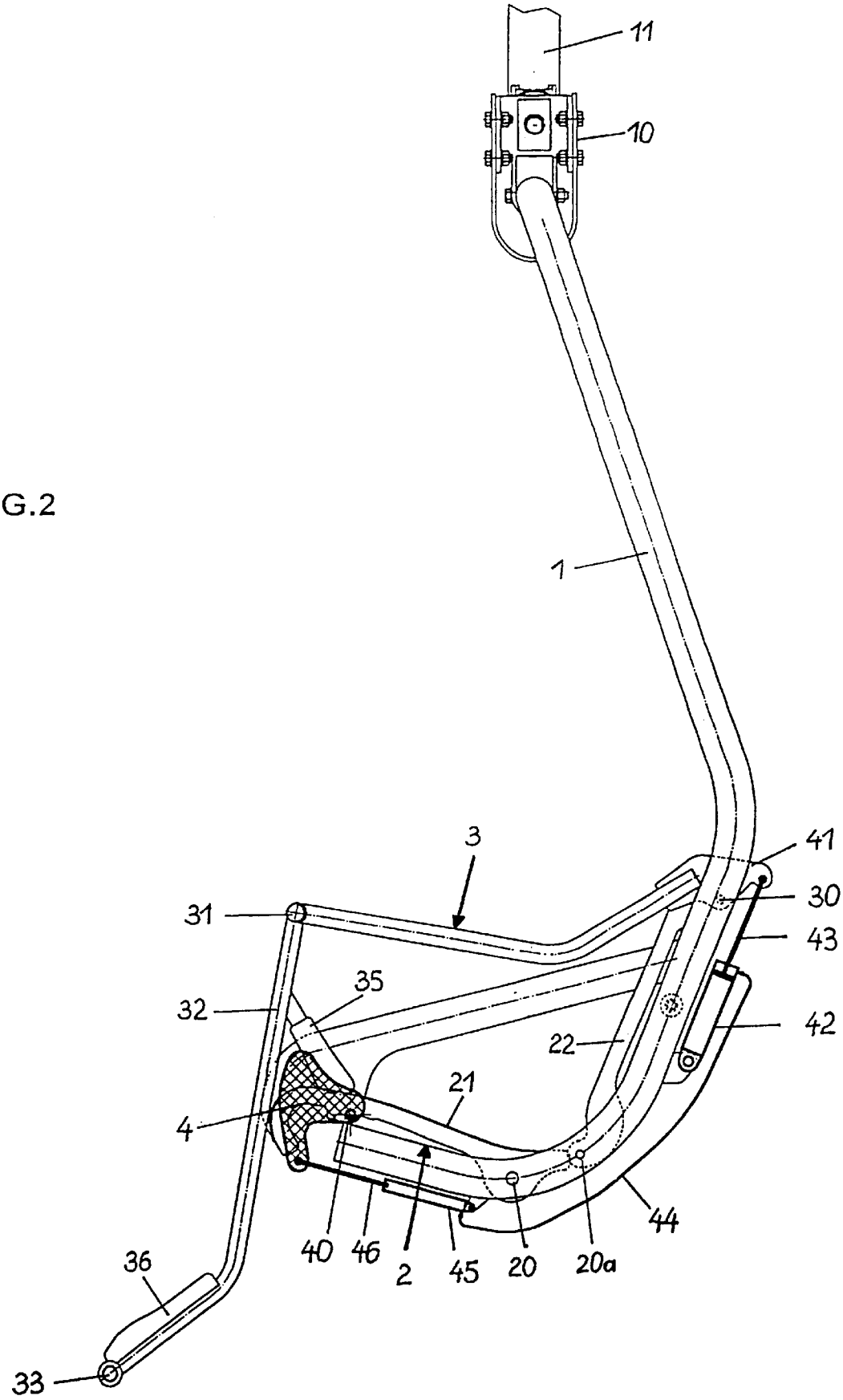
FIG. 2 is a side view of the chair with the closure bar in the closed position.
Figure 3:
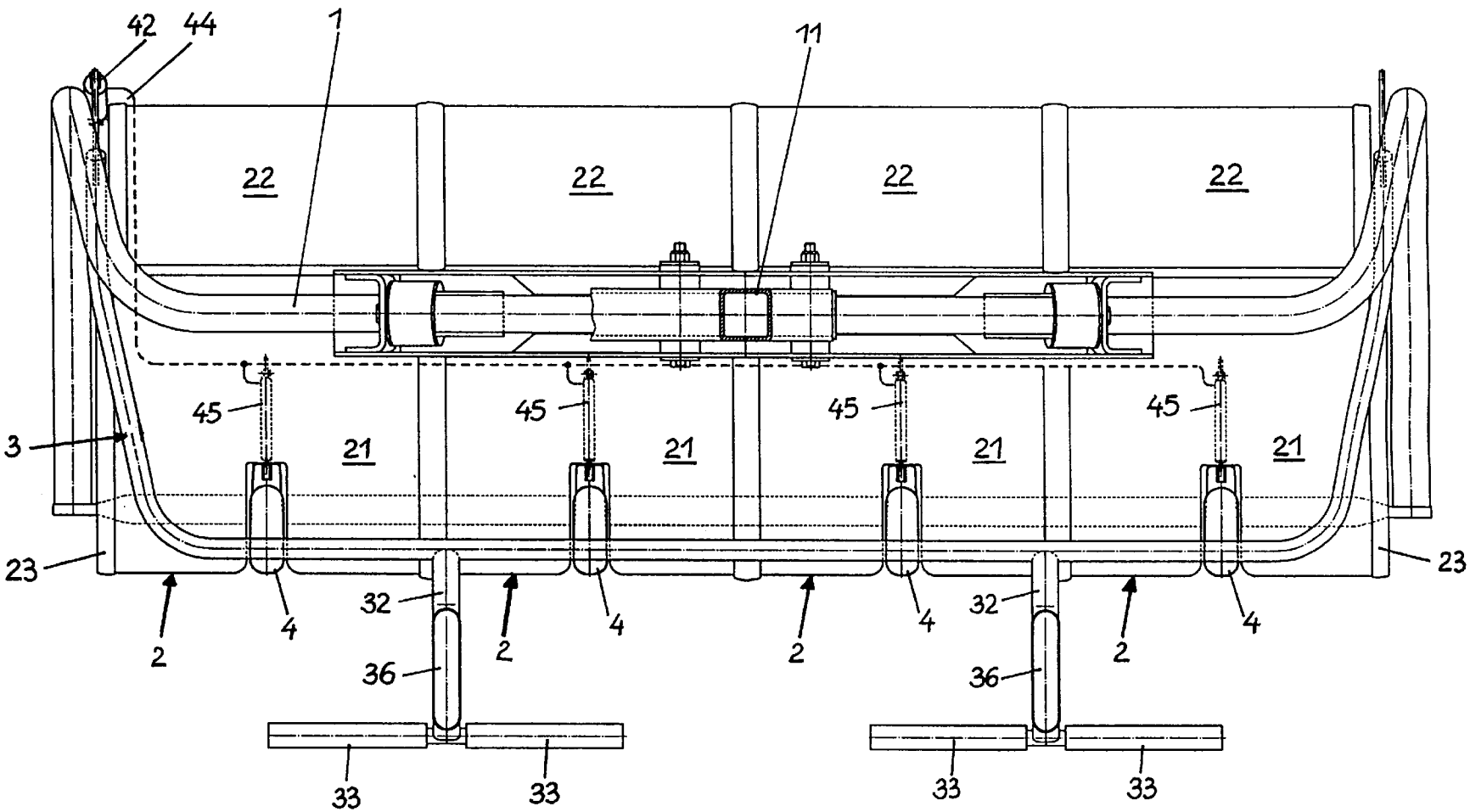
FIG. 3 is a plan view of the chair.

There is also provided a closure bar 3 which is mounted on a more or less horizontal pin 30, directed transversely to the travel direction of the chair, and which can be adjusted from the open position, which is illustrated in FIG. 1, into the closed position, which is illustrated in FIG. 2 and in which the longitudinal member 31 of the closure bar is located in front of the individual seats 2. Furthermore, the closure bar 3 is designed with downwardly projecting transverse members 32 between in each case two seats 2, footrests 33 each assigned to one seat 2 projecting from said transverse members. In addition, the closure bar 3 is designed with supporting arms 35, by means of which it is supported in its closed position in relation to the loading-bearing frame 1. The transverse members 32 are designed with stop buffers 36.

Finally, provided in the central region of each seat 2 is a cam device 4, in the form of a camming bulge, a protrusion, a tappet, or the like, which can likewise be pivoted about an axis 40, running transversely to the direction of travel of the chair, and is coupled in terms of movement to the closure bar 3 to the effect that, when the closure bar 3 is pivoted into its closed position, it is pivoted counter to the closure bar 3 in relation to the associated seat surface 21, as a result of which it passes into a position between the thighs of the user of the respective seat 2, in which case it forms a slipping-off-prevention means.

As can likewise be seen from FIGS. 1 and 2, a pivoting plate 41 is fastened on the closure bar 3, at at least one of the two lateral ends of the same, and can be pivoted about the axis 30. The piston rod 43 of a control cylinder 42 is articulated on the pivoting plate 41. The control cylinder 42 is connected, via pressure lines 44, in each case to an actuating cylinder 45 which is assigned to the seats 2 and of which the piston rod 46 is articulated to the respective protrusion 4.

By virtue of the closure bar 3 pivoting counterclockwise in the direction of the arrow A from its non-operational position, which is illustrated in FIG. 1, the pivoting plate 41 is likewise pivoted in the counterclockwise direction, as a result of which the piston rod 43 of the control cylinder 42 is extended. The actuating rod 46 of the actuating cylinder 45 is thus pushed out, as a result of which the cam devices 4 are pivoted clockwise in the direction of the arrow B into their active position 4.

This position of the cam devices 4 is illustrated in FIG. 2.

As an alternative to adjusting the cam devices 4 by means of a pressure medium, it is also possible to provide a lever linkage or traction chains, which are actuated by the closure bar pivoting. In addition, it is possible for the cam devices 4 to be connected to one another in groups, e.g. via a linkage, which can be pivoted by means of an actuating cylinder assigned to one group in each case.

I claim:

1. A chair assembly for a cableway system, comprising:

a chair formed with at least one seat;

a closure bar pivotally supported on said chair substantially transversely to a travel direction of said chair between a closed position and an open position;

a cam device disposed in a front region of said at least one seat, said cam device being coupled to said closure bar such that, when said closure bar is pivoted into the closed position, said cam device projects upward from a region substantially centrally and forward on said seat.

2. The chair assembly according to claim 1, wherein said cam device is pivotally disposed about an axis substantially parallel to a pivot axis of said closure bar.

3. The chair assembly according to claim 1, which comprises at least one control cylinder attached to said closure bar and actuated upon a pivoting of said closure bar, an actuating cylinder attached to said cam device, and a pressure-medium line connected between said actuating cylinder of said cam device and said control cylinder of said closure bar.

4. The chair assembly according to claim 1, wherein said at least one control cylinder is disposed at a rear side of said chair and said at least one actuating cylinder is disposed on an underside of said chair.

5. The chair assembly according to claim 3, wherein said at least one seat is one of a plurality of seats each provided with a respective said cam device, and wherein said control cylinder is connected to each of a plurality of said actuating cylinders via a respective pressure-medium line.

6. The chair assembly according to claim 5, wherein said cam device of each said seat is assigned a dedicated said actuating cylinder.

7. The chair assembly according to claim 5, wherein a plurality of said cam devices are mechanically connected to one another for common pivoting in at least one group of cam devices, and wherein said at least one group of cam devices is assigned a single actuating cylinder.

8. The chair assembly according to claim 1, which further comprises at least one footrest disposed below said seat.

9. The chair assembly according to claim 1, wherein said at least one seat is one of a plurality of seats, and a plurality of footrests of even number with a number of seats are disposed below said seats.

10. A chair assembly for a cableway system, comprising:

a chair formed with at least one seat for supporting a person thereon in a seating position;

a closure bar pivotally supported on said chair substantially transversely to a travel direction of said chair and movable into a closed position; and a cam device disposed in a front region of said at least one seat, said cam device being coupled to said closure bar such that, when said closure bar is pivoted into the closed position, said cam device is moved into a position substantially between two thighs of a person seated on said chair.

* * * * *